United States Patent [19]

Kerseg

[11] 3,956,917

[45] May 18, 1976

[54] METHOD AND APPARATUS FOR CUTTING AND FORMING PLANAR MATERIAL

[75] Inventor: Kurt C. Kerseg, La Crescenta, Calif.

[73] Assignee: Multifid Corporation, La Crescenta, Calif.

[22] Filed: June 4, 1975

[21] Appl. No.: 583,691

Related U.S. Application Data

[63] Continuation-in-part of Ser. No. 387,189, Aug. 9, 1973, abandoned.

[52] U.S. Cl. ..... 72/337; 72/332; 83/694; 113/119; 226/165

[51] Int. Cl.[2] ..... B21D 28/00

[58] Field of Search ..... 72/337, 332, 384; 29/203 R, 203 D, 630 E; 113/116 A, 116 Y, 116 Z, 119, 1 R; 83/620, 618, 622, 623, 694, 404, 408; 226/162, 165

[56] References Cited

UNITED STATES PATENTS

| | | | |
|---|---|---|---|
| 1,716,991 | 6/1929 | Turner | 83/694 |
| 2,696,380 | 12/1954 | Adams | 226/165 |
| 3,263,539 | 8/1966 | Daniel et al. | 83/620 X |
| 3,524,370 | 8/1970 | Thompson | 83/620 X |
| 3,525,138 | 8/1970 | Abbott | 113/116 A X |
| 3,569,897 | 3/1971 | Laube | 338/183 |
| 3,587,502 | 6/1971 | Murray | 113/1 R |
| 3,590,759 | 7/1971 | Hendrie | 113/116 A |
| 3,650,168 | 3/1972 | Ruschmann | 83/408 X |
| 3,733,573 | 5/1973 | Dieterich | 29/630 E X |
| 3,766,646 | 10/1973 | Froebe et al. | 29/630 E |

*Primary Examiner*—C. W. Lanham
*Assistant Examiner*—James R. Duzan

[57] ABSTRACT

A method and apparatus for cutting and forming planar strip material which is particularly useful in the fully automatic, high volume production of precision, microminiature multifid electronic brushes. With the apparatus of the invention, high quality electronic brushes are produced automatically from a continuous thin strip of metal or metal alloy. At predetermined locations along the length of the strip, the material is cut so as to form a multiplicity of precisely spaced apart longitudinally extending slits or incisions. The material is then automatically cut transversely of the slits so as to form a multiplicity of precisely spaced apart outwardly extending fingers. The fingers are then formed in a forming die to the cross-sectional configuration desired for end product use.

16 Claims, 17 Drawing Figures

2
98
30
40
78
56
114
76
38
60
118
68
C
36
90
D
E
A
B
42
66
62
116
120
10
10
74
92
34
80
32
82
58
110
112
100
122
2

18a
102
106
18
26
104
26
A
B
C
D
E
40
20
W
L
22
18a
ROUGH MATERIAL #1
CUT PORTION #2
IDLE #3
IDLE #4
IDLE #5
IDLE #6
TRIM FRONT OF BRUSH #7
CUTS OFF BACK & FORMS FRONT OF BRUSH #8

FIG. 2.
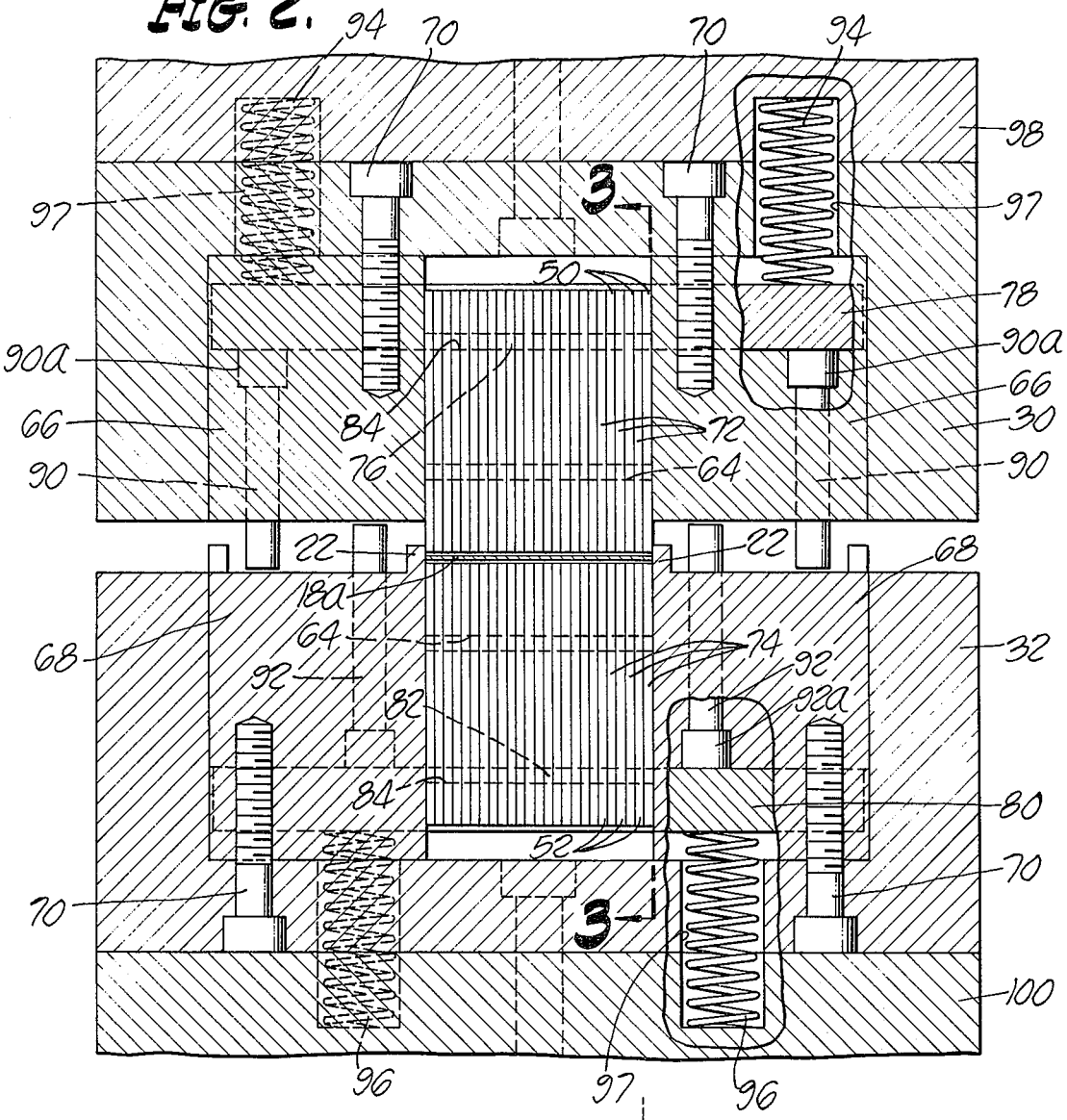
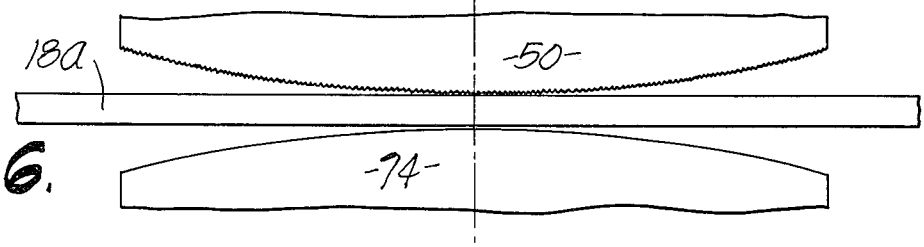
FIG. 6.
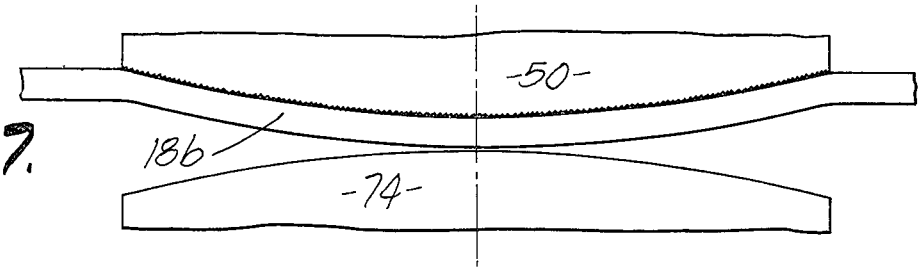
FIG. 7.

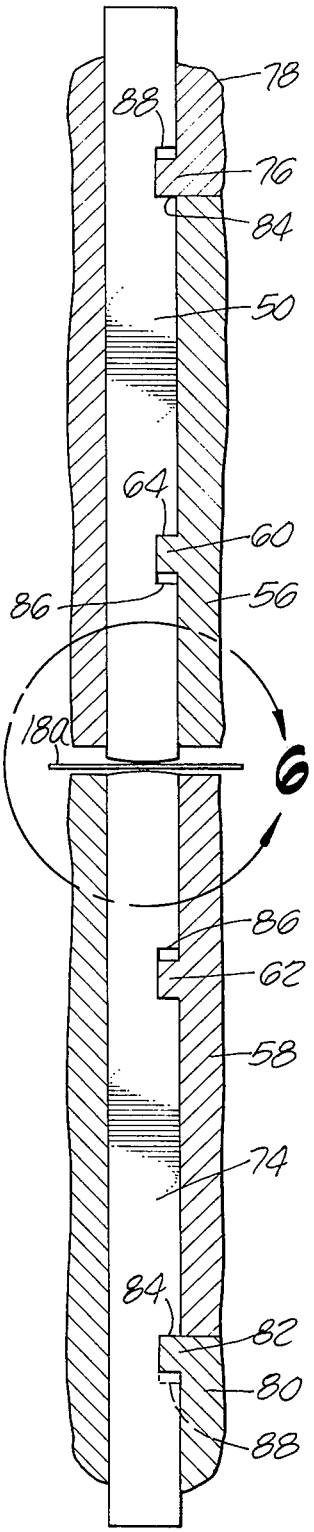
FIG. 3.
FIG. 4.
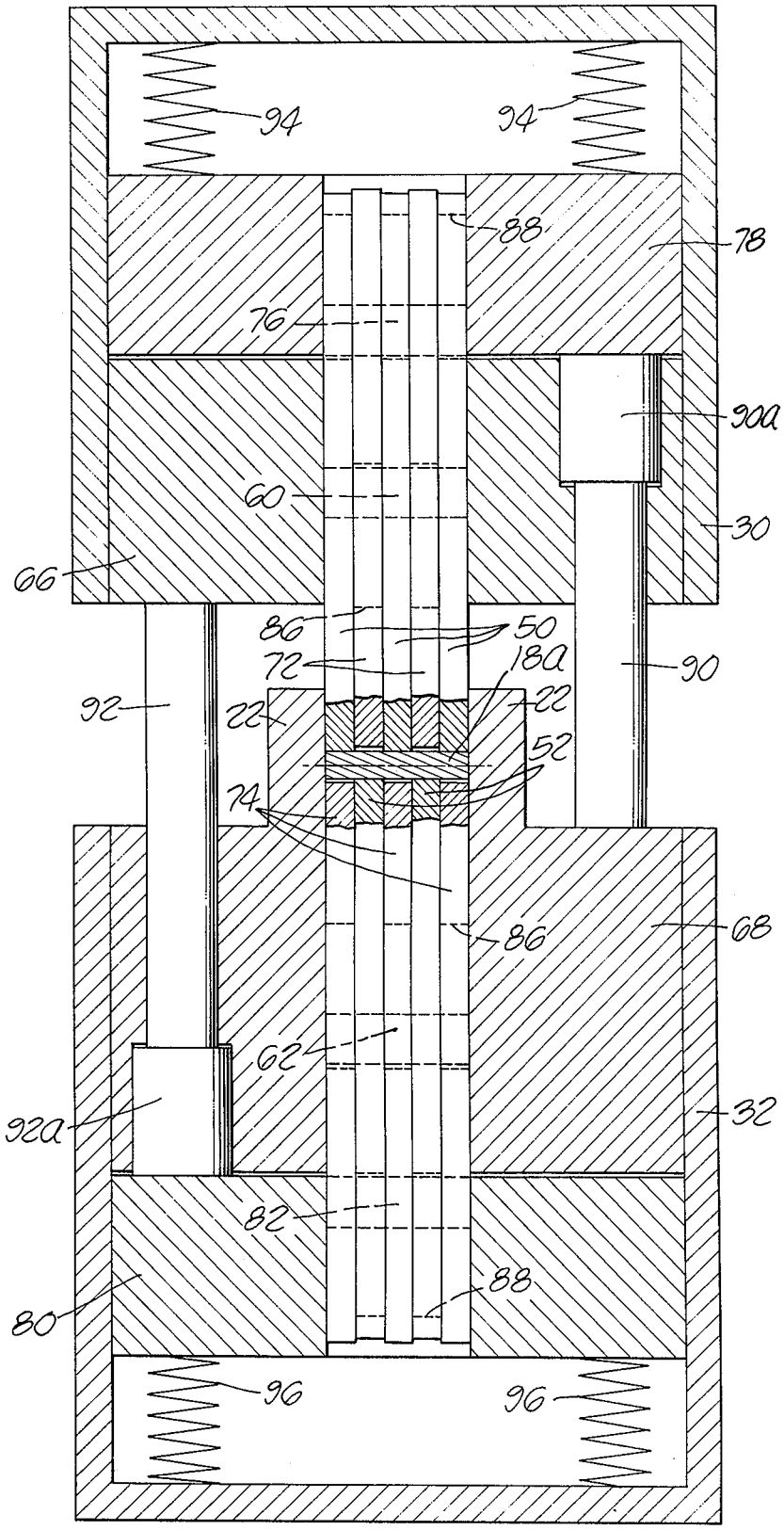

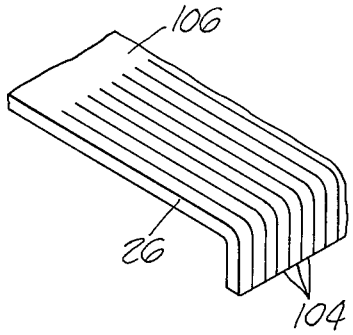
FIG. 8.
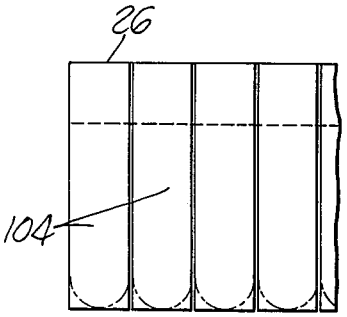
FIG. 9.
FIG. 5.
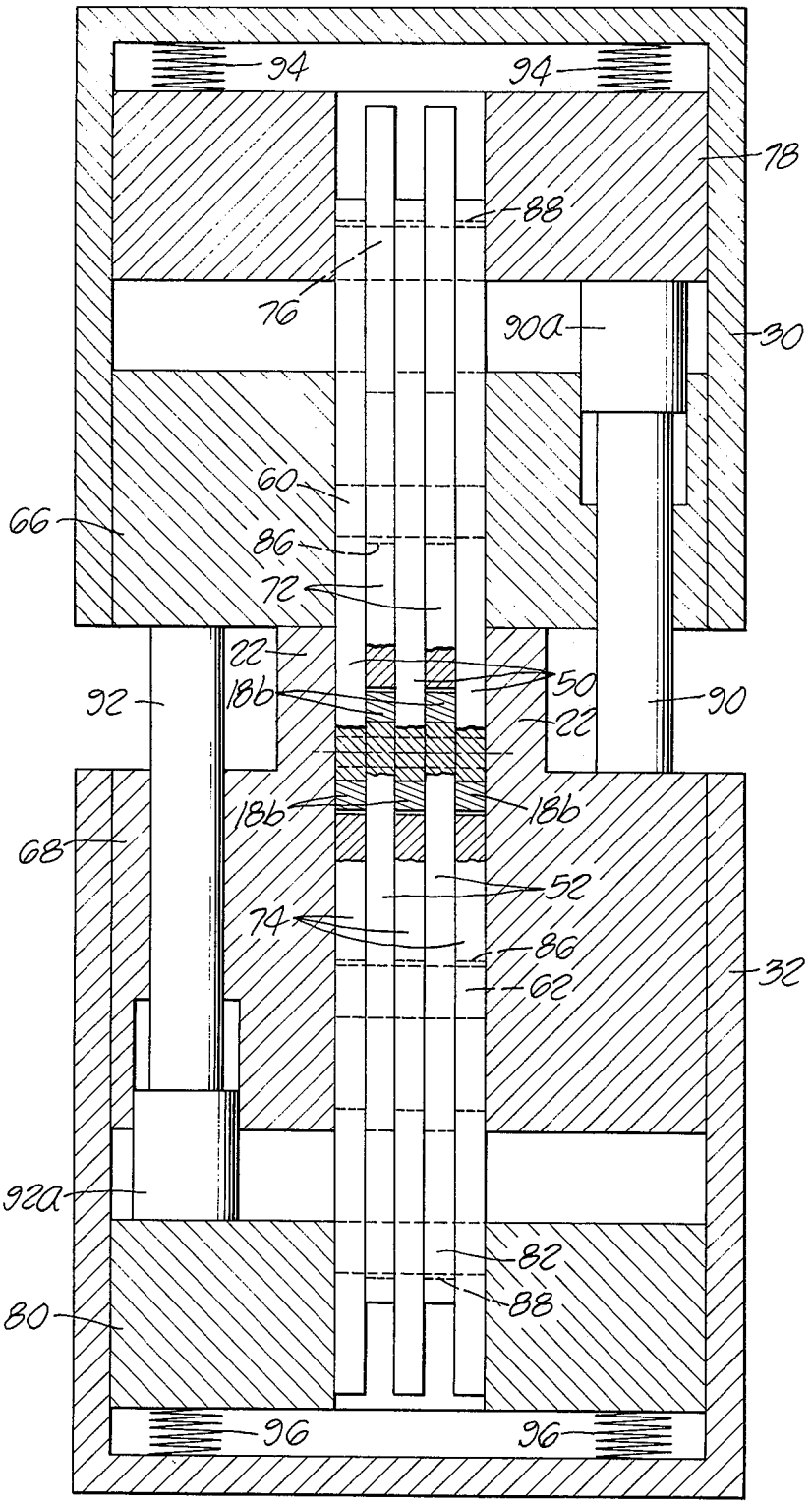

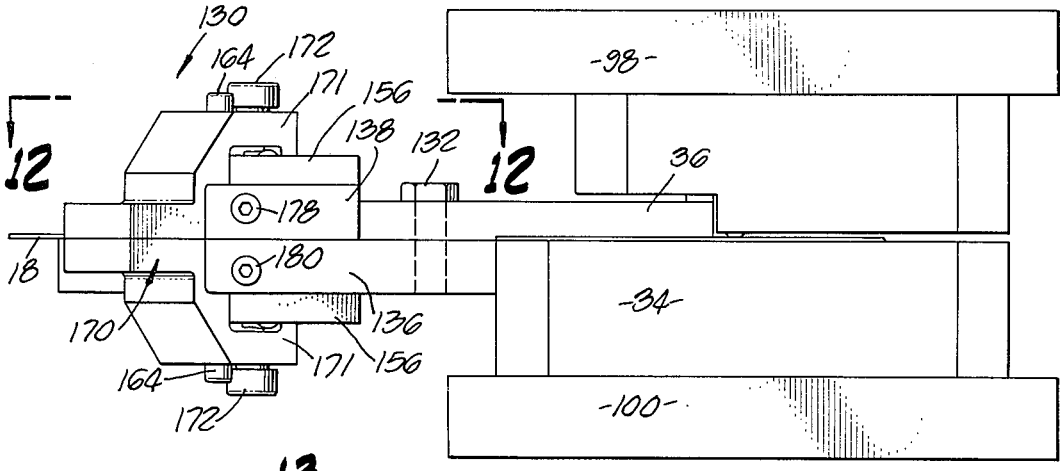
FIG. 11.
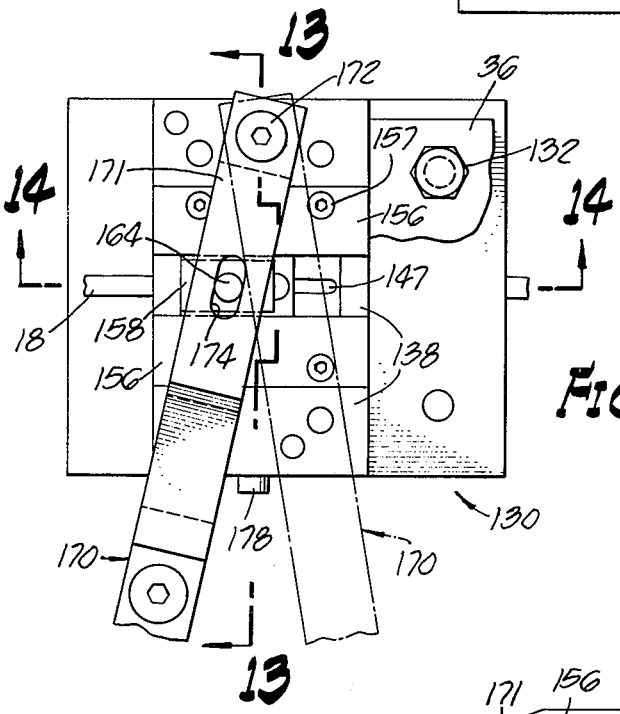
FIG. 12.
FIG. 13.
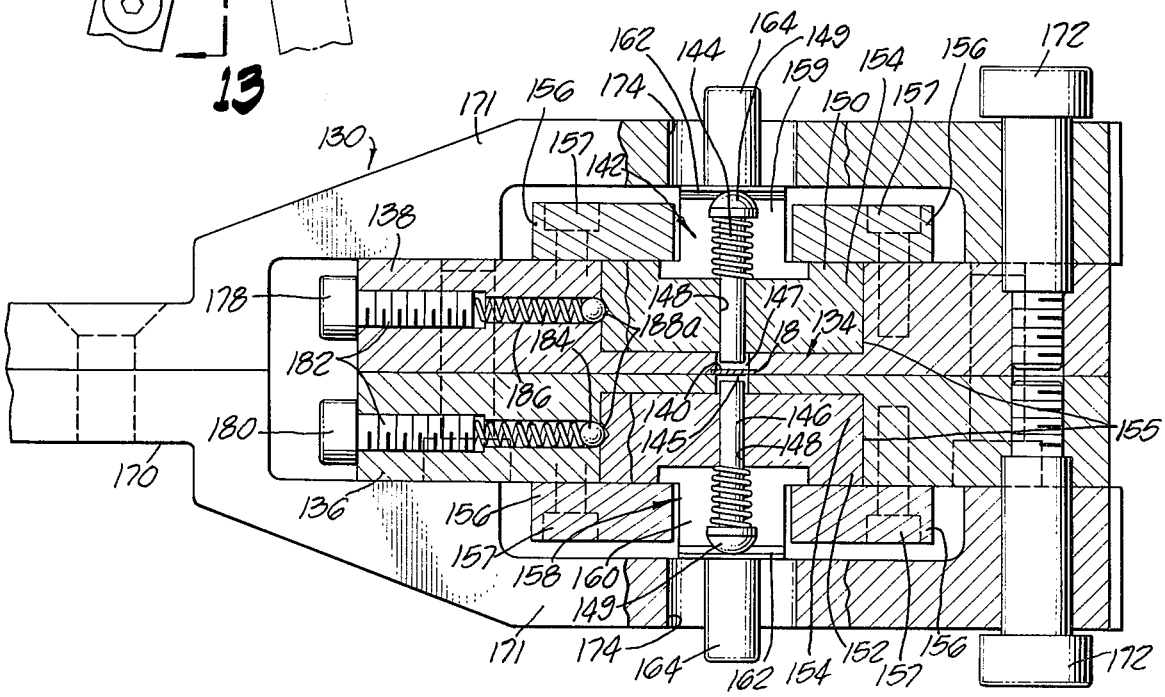

METHOD AND APPARATUS FOR CUTTING AND FORMING PLANAR MATERIAL

This application is a continuation-in-part of U.S. Pat. Ser. No. 387,189, filed Aug. 9, 1973, now abandoned.

BACKGROUND OF THE INVENTION

1. Field of the Invention

The present invention relates generally to electronic conductor elements and more particularly to electronic brushes for use in making electrical contact between stationary and moving surfaces.

2. Description of the Prior Art

Electronic brushes are used in a wide variety of electronic devices including computers, incoders, automatic control systems, alarm systems, trimmers, precision potentiometers and the like. In all of these devices, many of which embody several individual brush components, the brush performs the important function of making reliable electrical contact between the various stationary and moving surfaces of the devices.

With the great strides made in recent years in the development of solid state devices and printed circuitry and the concomitant miniaturization of electronic devices, the design and fabrication of electronic brushes, and particularly microminiature brushes, has taken on increased significance. This is true because in many types of electronic devices it is the brush more than any other single component which governs the over-all size and functional precision of the device. Where the surface over which the brush must make electrical contact is miniaturized, the brush itself must, of course, be correspondingly miniaturized. At the same time, however, the brush must meet rigid dimensional tolerances, must be capable of making effective electrical contact with the often irregular surfaces of the circuitry with which it cooperates, and, very importantly, must be constructed so as not to damage the surfaces with which it repeatedly comes in contact during the operation of the electronic apparatus. The ideal brush capable of satisfying these diverse requirements is one that has a great multiplicity of extremely fine contact segments, or fingers, each of which is very flexible yet rugged and each of which has a smooth or coined end contact portion. Experience has shown that the greater the number of small diameter, hair-like flexible fingers in any given brush width, the greater will be the likelihood of the brush making reliable electrical contact with the mating surface and the less will the chances be of undesirable arc erosion and circuit board wear.

In the past, electronic brushes were typically fabricated from a wide variety of metal alloys using generally standard tool and die techniques. The individual brush segments were generally formed by making several biforcations or slits in sheet metal material which had been cut to the desired dimensions. Because of size and mechanical limitations in the die forming apparatus, however, the number of segments or fingers which could be formed on miniaturized brushes was severely restricted.

In an attempt to overcome the limitations inherent in standard die fabrication techniques, the so-called "wire wound" method of brush construction was recently developed. This method basically consists of closely winding an appropriate metal alloy wire having a diameter of three- or four-thousandths of an inch onto a fiberglass drum approximately six inches in diameter and then electroforming a plurality of silver bars at right angles to the wires at spaced intervals around the drum. The matrix thus formed is then cut longitudinally of the drum, removed, and flattened into a planar sheet consisting of a plurality of wires interconnected at spaced intervals by the silver bars. The planar sheet is next cut into elongated strips each having a width equal to from 10 to 25 wires. Individual brushes are then formed by cutting the wires intermediate of the connecting silver bars. Where desired, the end portions of the brushes can then be formed in a forming die into the desired cross-sectional configuration.

Although the wire wound method has been demonstrated to be superior to prior art techniques for the fabrication of small multifid electronic brushes, several serious deficiencies have been found to exist in the brushes produced by this method. For example, because of silver creepage during the plating process, silver is deposited between the strands of wire. This causes excessive spreading of the fingers when the wires are cut to form the electronic brush and may result in a failure of the brush to meet critical dimensional tolerances on brush width. If close width tolerances are not met, the brush will improperly register with the electrical circuitry with which it cooperates and performance of the device will be degraded. Additionally, the silver plating on the individual fingers causes them to be less flexible and further contributes to poor brush performance. Also because of the stress formed in the wire during the coiling operation, after the wires are cut to form the brush the individual fingers tend to curl or otherwise deform beyond acceptable dimensional tolerances.

The unique design of the apparatus of the present invention permits the automatic production of precision microminiature electronic brushes comparable in size to the brushes formed by the wire wound method, at a fraction of the cost of the wire wound brushes. With the apparatus of the present invention, brushes are produced by a fully automatic process directly from a continuous strip of the metal alloy material. The time consuming and costly electroforming step of the wire wound method is completely eliminated, as is the silver creepage problem inherent in the wire wound process.

Additionally, because in the method of the present invention the brush segments or fingers are formed while the material is securely encapsulated within the apparatus in such a manner as to prevent any lateral deformation, undesirable built-in stresses in the material are eliminated and extremely close dimensional tolerances can consistently be maintained. The time consuming and costly hand operations of stripping the silver bar wire matrix from the plating drum and cutting it to size are also eliminated thereby contributing significantly to increased production rates and over-all cost reductions.

SUMMARY OF THE INVENTION

It is an object of the present invention to provide a novel method and apparatus for forming a multiplicity of precisely spaced apart slits or incisions in a thin planar material.

It is another object of the invention to provide a method and apparatus for expeditiously producing from a thin planar material a component part having a body portion and a multiplicity of precisely formed equally spaced outwardly extending finger-like projections.

It is another object of the present invention to provide a novel method and apparatus for the automatic cutting and forming of a strip of thin planar material in which a multiplicity of precisely spaced apart slits or incisions can be formed longitudinally of the strip of material without the material being deformed laterally as a result of the cutting operation.

It is a further object of the present invention to provide a method and apparatus for the automatic, continuous, large scale production of multifid electronic brush contacts from a continuous strip of thin planar material.

More particularly, it is an object of the present invention to provide a novel apparatus for automatically fabricating to extremely close dimensional tolerances micro-miniature brush contacts characterized by having a multiplicity of precisely formed, outwardly extending, flexible fingers or hair-like contact elements formed into a predetermined cross-sectional configuration.

It is still another object of the invention to provide a lancing mechanism in which a strip of this planar material is encapsulated between first and second sets of oppositely disposed cutting blades which are controllably movable into an interleaving relationship in a manner so as to form a multiplicity of precisely spaced apart slits in the strip of encapsulated material.

It is another object of the invention to provide a mechanism of the type described in the preceding paragraph in which movable spacer elements are interposed between the cutting blades to prevent deformation of the cutting blades during the lancing operation.

It is still another object of the invention to provide a novel method and apparatus for the fully automatic, high volume production of precision microminiature multifid brush contacts at a very rapid rate and low unit cost.

In summary, these and other objects of the invention can be realized by an apparatus for cutting and forming a planar material including a first assembly carrying a plurality of spaced apart cutting blades; a second assembly oppositely disposed from the first assembly for carrying a plurality of spaced apart second cutting blades in planes substantially parallel to, but in a staggered relationship with, the planes of the first cutting blades; guide members for positioning the material to be cut between the cutting blades in a manner so as to prevent lateral deformation of the material during the cutting operation; and a mechanism for exerting a force to move the first and second assemblies in a direction toward one another in a manner so as to move the cutting blades carried thereby into an interleaving relationship.

BRIEF DESCRIPTION OF THE DRAWINGS

FIG. 2 is a vertical cross-sectional view taken along line 2—2 of FIG. 1 showing the apparatus significantly enlarged over FIG. 1 and partly broken away to illustrate the internal construction of the lancing subassembly of the apparatus. This view shows the material to be cut in position within the material support or guide means of the apparatus and the cutting and spacer elements or blades of the apparatus as they appear at the beginning of the cutting cycle.

FIG. 3 is a view taken along line 3—3 of FIG. 2 and is a greatly enlarged cross-sectional view of the cutting and spacer blades of the lancing subassembly showing a side view appearance of the blades and illustrating the manner in which the blades are operatively interconnected with the movable top and bottom spanner members or blade holding means of the apparatus.

FIG. 4 is a generally schematic view of the lancing subassembly of the apparatus shown at a first position with the cutting blades in first contact with the material to be cut. This view is similar to that shown in FIG. 2, but is further enlarged and shows only a limited number of blades so that the relative movement among the blade holding means, the cutting blades and the spacer blades during the cutting operation can be more easily illustrated and described.

FIG. 5 is a generally schematic view similar to FIG. 4 showing the lancing subassembly in a second position in the cutting cycle.

FIG. 6 is still a further enlargement of the encircled portion of FIG. 3 showing the working curved edge portions of the cutting and spacer blades as they appear at a first position with the cutting blade in first contact with the material to be cut.

FIG. 7 is a view similar to FIG. 6 showing the blades in a second position in the cutting cycle.

FIG. 8 is a perspective view of a portion of the multifid brush which is the end product produced by this embodiment of the invention.

FIG. 9 is a front view of the multifid brush contact illustrated in FIG. 8 showing the manner in which the lower end portions of the brush contacts or fingers are coined by the apparatus.

FIG. 11 is a side elevational view of another embodiment of the invention including a novel feeding mechanism. The cutting and forming portion of the apparatus shown in FIG. 11 is identical to that shown in FIG. 1. The unique feeding mechanism of this form of the invention is shown affixed at the forward or left end of the cutting and forming portion of the apparatus.

FIG. 12 is a plan view of the feeding mechanism taken along lines 12—12 of FIG. 11 and is partly broken away to show internal construction.

FIG. 13 is a view partly in cross-section taken along lines 13—13 of FIG. 12.

Figure 14:
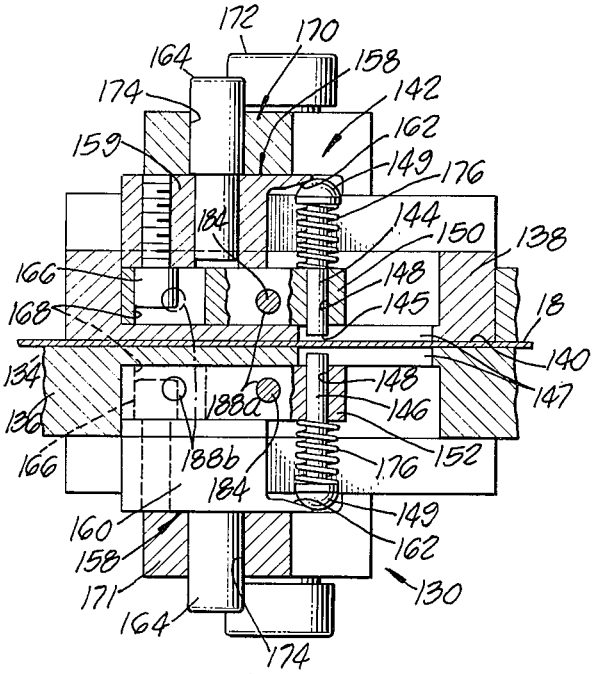
FIG. 14 is a cross-sectional view taken along lines 14—14 of FIG. 12.

15 is a view similar to FIG. 14 but illustrating the appearance of the mechanism after the actuating cam members have moved to the right to bring material gripping fingers into engagement with the material to be processed in the apparatus.

Figure 15:
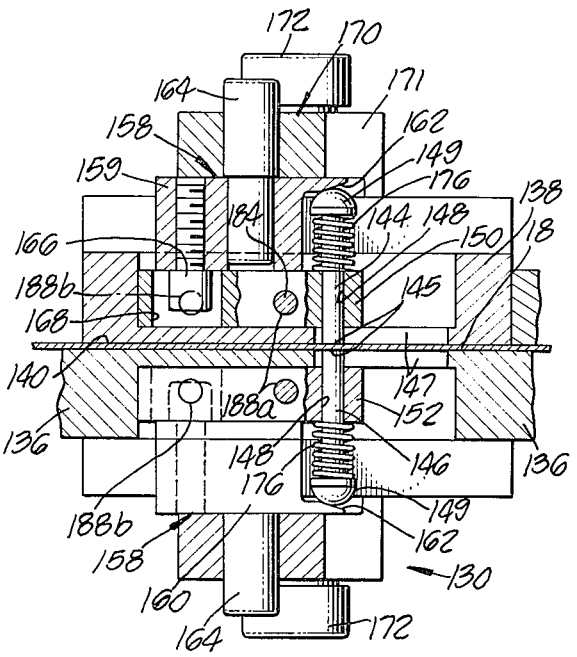
Figure 16:
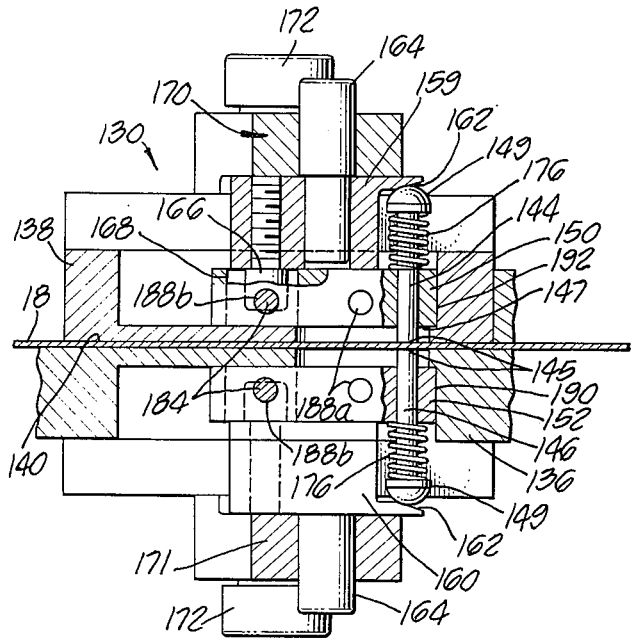

FIG. 16 is a view similar to FIG. 15 but showing the appearance of the mechanism after the shuttle and cam members have been moved forwardly or to the right to advance the material a fixed distance toward the cutting and forming apparatus.

Figure 17:
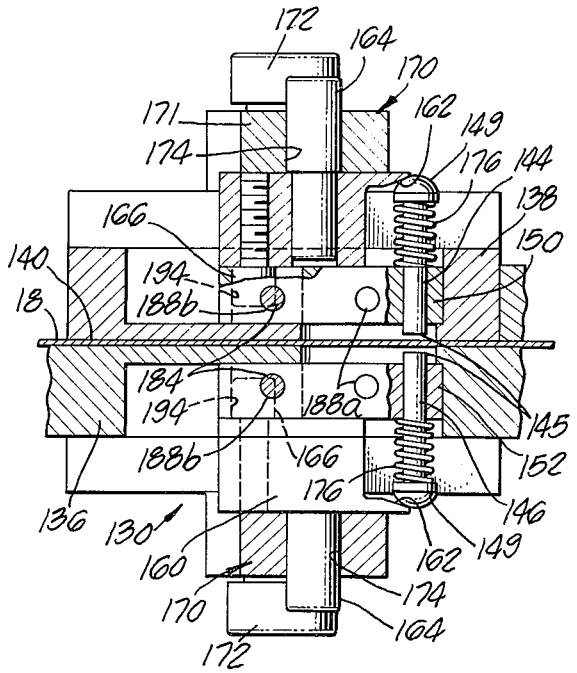

FIG. 17 is a view similar to FIG. 16 but showing the appearance of the mechanism after the actuating means have been moved to the left to permit the gripping fingers to disengage the material so that the mechanism can be returned to the position illustrated in FIG. 14.

DETAILED DESCRIPTION OF THE INVENTION

Figure 1:
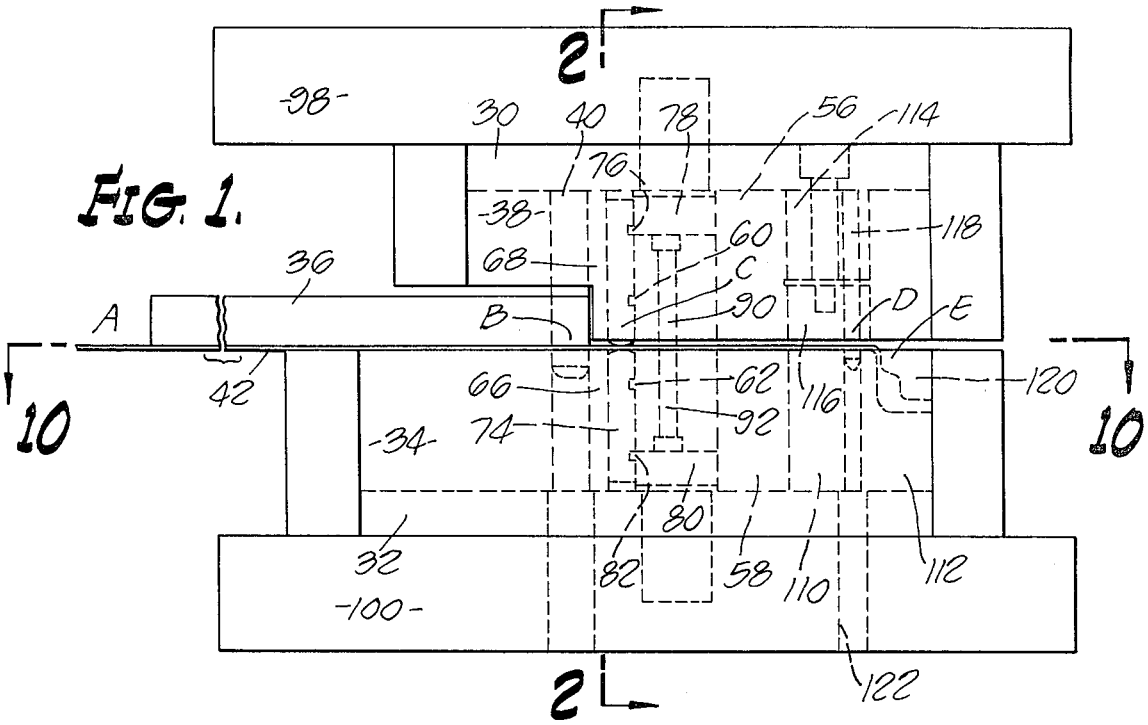
FIG. 1 is a side elevational view of the cutting and forming apparatus of the invention.
Figure 10:
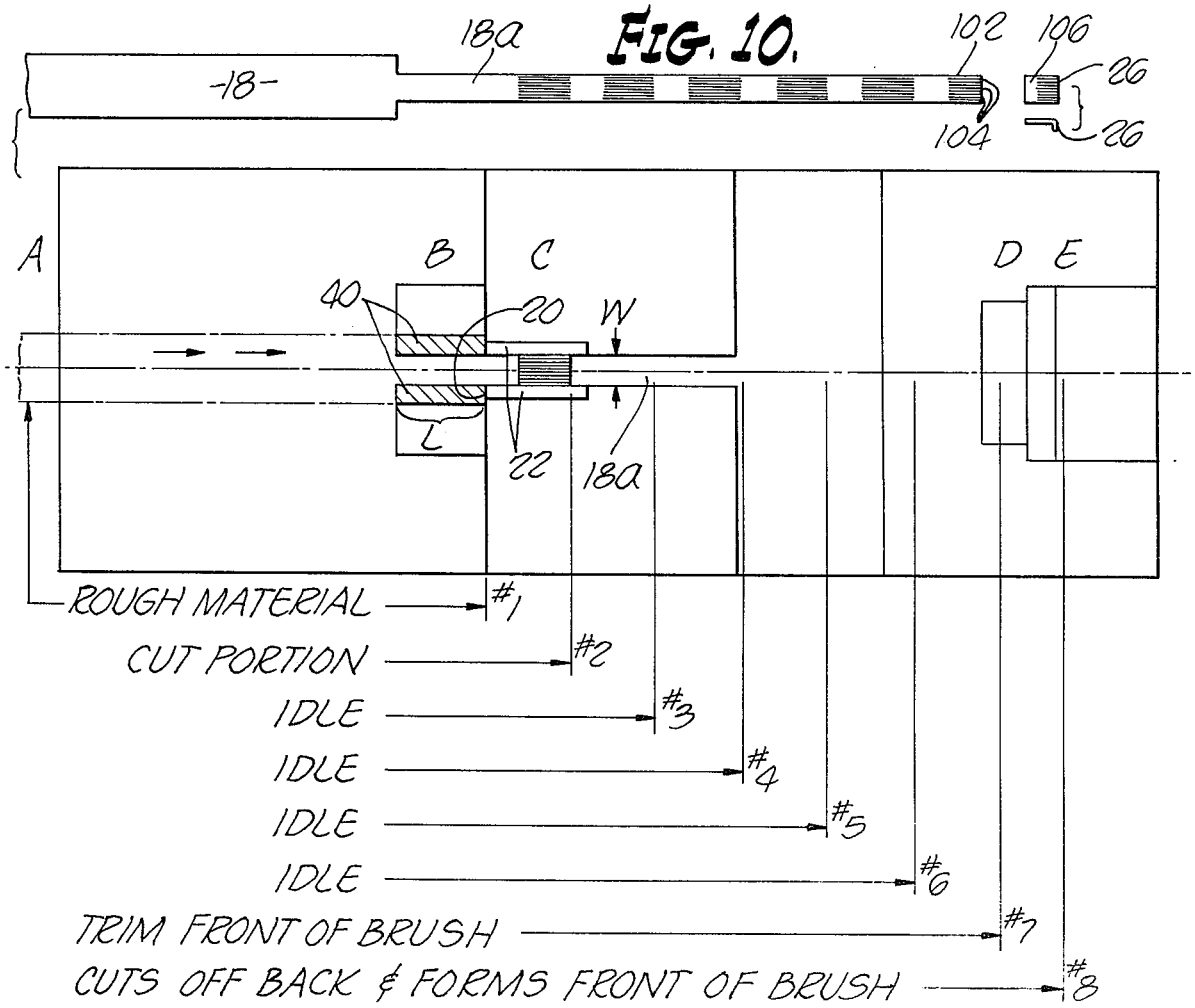
FIG. 10 is a generally schematic plan view of the lower half of the apparatus taken along line 10—10 of FIG. 1 illustrating the various steps of the process for making a microminiature multifid brush contact and also illustrating the configuration of the material during the various process steps.

Referring now to the drawings and particularly to FIGS. 1 and 10, the various steps in the process of the manufacture of microminiature multifingered or multifid electronic brushes using the apparatus of the invention, are generally indicated by the letters A through E. At A the thin strip of raw material to be cut and formed is continuously fed into the apparatus by a feed means comprising cooperating friction rollers or a similar type of automatic feeding mechanism suitable for the purpose (not shown). The material from which the brushes are manufactured may be chosen from a wide variety of electrically conductive metals and metal alloys including nickel, beryllium-copper, phosphor-bronze and gold-silver-platinum-rhodium alloys.

As indicated in FIG. 10 the strip of raw starting material 18 moves forwardly of the apparatus through a longitudinally extending guide channel until it engages stop means indicated in FIG. 10 by the numeral 20. Stop means 20 positions the strip for the first cutting operation indicated by the letter B. During this step, the material is cut along a predetermined distance to a precise width by means of a first punch and die subassembly, the details of construction of which will presently be described. The portion of the strip thus cut moves forwardly or to the right as viewed in FIGS. 1 and 10, between spaced apart first guide means generally indicated in FIG. 10 by the numeral 22. Guide means 22 serves to position the strip laterally within the apparatus and also closely engages the marginal edges of the material so as to prevent any lateral deformation of the material during the second cutting or lancing operation indicated at C. At step C, a plurality of longitudinally extending precisely spaced apart cuts are made in the strip of material.

After the material is cut at steps B and C, the strip is moved forwardly of the apparatus within guide means 22 through several idling steps as identified in FIG. 10. When the first lanced out portion of the strip reaches the cutting and forming location generally indicated in FIG. 1 by the letter D, the strip is cut transversely of the lanced out or slitted portion so as to form a multiplicity of outwardly projecting spaced apart fingers. Next, the strip is moved forwardly until the following slitted portion reaches location D. Again the strip is cut transversely of the slitted portions and simultaneously is cut at a location rearwardly of the first or preceding lanced out portion, thereby forming the discrete brush segment indicated in FIG. 10 by the numeral 26. Finally, at step E, the forward end of the brush 26 is formed in a forming die to the desired cross-sectional configuration, the ends of the fingers are coined, and the brush having a configuration illustrated in FIGS. 8 and 9 is removed from the apparatus for packaging.

In the description of the apparatus of the invention which follows, it is important for the reader to keep in mind that because of the smallness of the apparatus, a departure from scale in the drawings has been necessary to clearly illustrate the cooperative interaction of the various subassemblies and component parts of the device. By way of example, the strip of material to be cut and formed by the apparatus of the embodiment of the invention shown in the drawings is on the order of 0.100 inches wide and 0.004 inches thick. Referring to FIG. 4, the total width of the apparatus illustrated in this figure is on the order of 2½ inches and the cutting or lancing blades generally designated by the numerals 50 and 52 are on the order of one inch long and 0.004 inches in thickness. The electronic brush formed by the particular apparatus illustrated in the drawings is on the order of 0.100 inches wide and has twenty-five outwardly protruding uniformly spaced apart fingers each approximately 0.004 inches in width.

Referring now particularly to FIGS. 1 and 4, it can be seen that the various cutting and forming subassemblies of the apparatus are typically constructed of cooperating spaced apart upper and lower die sections which are held securely in position within upper and lower die enclosures 30 and 32 by means of bolts or other suitable fasteners. The first operating subassembly, or first cutting means, for cutting the strip of raw material to a predetermined width includes a die means comprising a lower die section 34 affixed within die enclosure 32, an elongated stripper block 36 disposed adjacent the lower die section and an upper die section 38 affixed within die enclosure 30 in a spaced apart relationship with the stripper block. Operatively received within the die means are a pair of spaced apart cut off punches 40 which are adapted to move downwardly through guide channels or slots provided in the stripper block and die sections and into cutting engagement with the marginal side portions of the strip of material 18.

Provided in operative association with the die means is a first guide means shown here in the form of a longitudinally extending guide channel formed in the lower surface 42 of the stripper block. The first guide means serves to guide the strip of raw material 18 into position between the upper and lower die sections and accurately positions it within the apparatus for the shearing operation at B which is accomplished by the cut off or notching punches 40. A suitable first force exerting means, as for example a pneumatic, electric, mechanical or hydraulic powered piston assembly (not shown), is operatively coupled with the cutting punches and is adapted to controllably move the punches within the guide channels of the die sections in a direction generally normal to the plane of the strip of material with a force sufficient to cut the marginal edges of the material.

During the cutting or shearing operation at B, the strip of material is held closely encapsulated between the stripper block and the lower die section with the center portion thereof rigidly supported so that as the notch punches move downwardly within the guide channels of the die sections the marginal edge portions of the material will be cleanly and accurately sheared along a distance equal to the width of the punches 40. As shown in FIG. 1, suitable openings are provided in the lower die enclosure 32 for removal of the portions of the material which are cut away. As previously noted, after shearing step B, the strip of material, which has been cut to the exact width W (indicated in FIG. 10 by the numeral 18*a*), is moved within guide means 22 a distance equal to the length L of the cut made by the notching punches. This positions the material for the important lancing step of the invention.

As illustrated in FIG. 1, the lancing subassembly or second cutting means of the invention is located forwardly of the first cutting means at location C. Referring now particularly to FIGS. 1, 2 and 3, the lancing subassembly can be seen to comprise a first movable means located on the first side of the strip of material 18*a* and adapted to carry a plurality of spaced apart first cutting blades 50; a second movable means oppositely disposed from the first means and located on the second side of the strip of material 18*a* for carrying a plurality of spaced apart second cutting blades 52 disposed in planes substantially parallel to, but in a staggered relationship with, the first cutting blades; and guide means for accurately positioning the strip of material between the cutting blades. This guide means, previously identified by the numeral 22, also serves the very important function of closely engaging the lateral margins of the strip of material in a manner to prevent lateral deformation of the material during the lancing or cutting operations.

In the embodiment of the invention shown in the drawings, the first and second means for carrying the cutting blades are provided in the form of upper and lower die sections 56 and 58 respectively (FIGS. 1 aand 3). These die sections are fixedly mounted within upper and lower die enclosures 30 and 32 and include first and second spanner members 60 and 62 respectively. These spanner members, shown here as transversely extending outwardly protruding bar-like projections formed integrally with the die sections, are adapted to engage interengaging means provided on the cutting blades depicted in the drawings as notches 64 which, in this embodiment, are formed in the edge portions of each of the cutting blades. As will be discussed in greater detail in the paragraphs which follow, as die sections 56 and 58 are moved toward each other, the cutting blades carried by the spanner members will correspondingly move toward one another into an interleaving relationship as illustrated in FIG. 5.

As best seen in FIG. 2, the upper and lower sets of cutting blades are held captive within the apparatus between pairs of upper and lower die sections 66 and 68 which die sections are also fixedly secured within upper and lower die enclosures 30 and 32 by means of bolts 70. Guide means 22 are shown in this form of the invention as upwardly extending projections provided at the inner margins of die sections 68.

Also forming a part of the lancing subassembly is a plurality of first and second spacer elements or blades 72 and 74 (FIG. 2) disposed in interleaving relationship with the first and second cutting blades 50 and 52. As clearly shown in FIG. 2, first spacer blades 72 are interconnected with a transversely extending spanner member 76 provided on an upper pressure pad member 78 which in this embodiment of the invention comprises a third movable means for moving the spacer blades in a direction away from cutting blades 52 as the cutting blades are moved into an interleaving relationship with cutting blades 50.

Similarly, second spacer blades 74 are interconnected with fourth movable means, provided in the form of a lower pressure pad 80 having a transversely extending spanner member 82 for moving the spacer blades in a direction away from cutting blades 50 as the cutting blades are moved into an interleaving relationship with cutting blades 52. As will be later discussed, the spacer blades perform the important function of preventing deformation of the cutting blades during the lancing operation.

By referring to FIGS. 1 and 3, it can be seen that the spacer blades 72 and 74 are provided with means in the form of notches 84 formed in the edges of the blades for interengaging the spanner members 76 and 82. It will also be observed that the spacer blades are provided with slightly wider notches 86 located closer to their inner curved ends to accomodate free movement of spanner members 60 and 62 of the die sections 56 and 58. Similarly, as shown in FIG. 3, the cutting blades 50 and 52 are also provided with slots 88 located near their outer ends to accomodate free movement of spanner members 76 and 82 of pressure pads 78 and 80. The purpose of these last described notches will become apparent from the description which follows.

Referring again to FIGS. 1 and 2, it can be seen that the upper and lower die sections 66 and 68 are provided with a plurality of generally vertically extending bores adapted to slideably accomodate upper and lower cylindrically shaped reaction means in the form of push rods 90 and 92 each of which have enlarged head portions 90*a* and 92*a* respectively. When the apparatus is at rest, as shown in FIG. 2, the head portions of the push rods are disposed in engagement with the inner surfaces of pressure pads 78 and 80, and the opposite or inner ends of the push rods are slightly spaced apart from the inner surfaces of the upper and lower die sections 66 and 68. As will be described in more detail in the section herein entitled Operation of the Lancing Subassembly, the reaction means or push rods 90 and 92 form a part of the operating means of the invention which serves to move the pressure pads and the interconnected spacer blades outwardly in response to inward movement of the upper and lower die members of the subassembly.

As illustrated in FIG. 2, pressure pads 78 and 80 are arranged to move outwardly against the urging of biasing means which is shown in this embodiment as comprising pairs of upper and lower coil springs 94 and 96. Springs 94 and 96 are located within cylindrical bores 97 provided in the base portions of the upper and lower die enclosures 30 and 32 and are held captive between the upper and lower pressure pads 78 and 80 and the upper and lower pressure plates designated by the numerals 98 and 100. These pressure plates engage the outer surfaces of the base portions of the upper and lower die enclosures and form a part of the second force exerting means of the invention. The second force exerting means also includes a mechanical, electrical, hydraulic or pneumatic force generating mechanism (not shown) of a type well known in the art which can be operatively coupled with the pressure plates 98 and 100 in a manner so as to move the upper and lower portions of the lancing subassembly uniformly toward one another in a controlled manner.

Operation of the Lancing Subassembly

The operation of the lancing step of the invention can perhaps best be understood by referring to FIGS. 2, 4 and 5 of the drawings. In FIG. 2, the various components of the subassembly are shown as they appear with the apparatus at rest. FIG. 4, which it must be recognized is generally schematic in nature and for purposes of illustration shows only a limited number of the cutting and spacer blades, illustrates the appearance of the apparatus after the upper and lower portions of the lancing subassembly have been moved by the second force exerting means uniformly toward one another a limited distance. Because of the fact that the upper and lower cutting blades 50 and 52 are operatively interconnected with the spanner members 60 and 62 of die sections 56 and 58 respectively, blades 50 have correspondingly moved downwardly to a position of engagement with the upper surface of the strip of material 18*a*. Similarly, cutting blades 52 have moved upwardly a corresponding distance into engagement with the lower surface of the material. Although only three upper and two lower cutting blades are shown in FIG. 4, it is to be understood that in actual practice, as illustrated in FIG. 2, there are provided within the apparatus thirteen upper and twelve lower cutting blades each approximately 0.004 inches in thickness.

As can be seen in FIG. 4, the relative movement of the upper and lower die sections toward one another also causes the inner ends of the push rods 90 and 92 to move into engagement with die sections 68 and 66 respectively. Because the push rods are slideably movable within the die sections and have their outer ends in engagement with the pressure pads 78 and 80, the relative movement of the upper and lower die sections causes the pressure pads to move outwardly against the urging of biasing means or springs 94 and 96. This movement of the pressure pads in turn causes the upper and lower spacer blades 72 and 74, which are operatively coupled to the spanner members 76 and 82 of the pressure pads, to move outwardly relative to the cutting blades with which they are interleaved.

It is to be observed that the notches provided in the cutting blades to accomodate the spanner member of the pressure pads are of such a width as to permit the spanner member to move outwardly without interference to the simultaneous downward movement of the cutting blades. Similarly, the notches provided in the spacer blades to accomodate the spanner members of the die sections 56 and 58 are configured to permit the spanner members to move inwardly toward the strip of material to be cut without interfering with the simultaneous outward movement of the spacer blades.

Referring now to FIG. 5, the relative position of the various elements of the lancing subassembly is illustrated subsequent to continued movement of the upper and lower sections of the subassembly toward one another. At this point in the operation, the lancing of the material 18*a* has been accomplished and the subassembly is ready to return to its rest position preparatory to commencement of the next lancing operation. In the orientation of the lancing subassembly illustrated in FIG. 5, the upper and lower die sections 66 and 68 have moved a maximum distance and the upper surfaces of guide member 22 are in engagement with the lower surfaces of die sections 66. Upper and lower cutting blades 50 and 52 have moved into an interleaving relationship and, against the urging of springs 94 and 96, the pressure pads 78 and 80 have been moved outwardly by push rods 90 and 92. This outward movement of the pressure pads has also moved the upper and lower spacer blades 72 and 74 outwardly a distance corresponding to the inward movement of the cutting blades.

By referring concurrently to FIGS. 5, 6 and 7, the cutting or lancing action of the cutting blades and the cooperative interaction of the spacer blades can perhaps best be understood. As shown in FIGS. 6 and 7, the curved leading or cutting edge of the cutting blades, identified in these figures by the number 50, are specially ground to present a roughened, sawtooth-like effect which prevents the material being cut from slipping or tearing during the lancing operation. The curved leading edges of the spacer blades (identified as 74), however, are ground to a smooth highly polished finish. This was found necessary because the spacer blades perform the dual function of eliminating deformation of the cutting blades, and also serve to assist in ejecting metal segments or particles from between the cutting blades as the subassembly returns to its starting position. By grinding the leading edge to a smooth finish, the washing or chip ejecting action of the spacer blades is significantly improved.

As the cutting blades move inwardly into an interleaving relationship, the portion of the material in contact with the curved surface of each of the blades is deformed in the direction of movement of the blades. As shown in FIG. 7, due to the novel construction of the subassembly, as previously described, this movement of the cutting blade is closely tracked by the opposing spacer blade so that the spacing between the curved edges of the two blades remains constant. With the construction thus described, the movement of adjacent cutting blades in opposite directions relative to the completely encapsulated material will cause the material to be cleanly and precisely lanced along locations intermediate the adjacent cutting blades in a manner as to form the material (identified as 18b) into the cross-sectional configuration illustrated in FIG. 5.

As a result of the precision construction of the lancing mechanism, the cooperative interaction of the cutting and spacer blades, the novel grinding of the blades and the fact that the material is closely encapsulated during the cutting operation, twenty-five precisely spaced apart cuts can be made longitudinally of a 0.100 inch wide strip of material at 0.004 inch intervals without lateral deformation of the material and without any tearing or structural damage resulting to the finger-like segments 18*b* thus formed.

Referring again to FIGS. 1 and 10, subsequent to the lancing operation the strip of material is moved through several idling steps which are necessary in order to accomodate the physical size and side-by-side orientation of the various subassemblies of the apparatus. As the first slitted portion of the material reaches point D, the third cutting operation is accomplished by a third cutting means which cuts the strip of material transversely of the slitted portion so as to form a multiplicity of spaced apart finger-like projections. The strip is then moved to the position shown by the brush 26 in FIG. 10. This locates the second slitted portion 102 at position D and the third cutting step is repeated, cutting the second slitted portion transversely to form spaced apart fingers 104. Simultaneously, a fourth cut is made transversely of the solid portion 106 of the strip located rearwardly of the first or forward slitted portion. As can be seen by referring to FIG. 10, as the strip moves sequentially forward the third cut (step No. 7) forms the fingers of one brush and the fourth cut shears the solid portion of the strip located forwardly thereof so as to form a discrete brush component the fingers of which had been trimmed during the previous cycle. At the same time the fourth cut is made the finger-like projections of the brush are formed at step E into a predetermined cross-sectional configuration. The third and fourth cutting operations and the brush forming operation just described is accomplished by a cutting and forming subassembly which, as best seen in FIG. 1, comprises a lower die section 110 and a cut off and form block 112 carried by lower die enclosure 32. Comprising the upper portion of the cutting and forming subassembly is an upper die section 114 carried by upper die enclosure 30, a movable pressure means 116 located adjacent die section 114 for holdably engaging the strip of material, a cut off punch 118 movably guided within guide channels provided in die section 114 and pressure means 116, a form punch 120 movably supported by upper die enclosure 32 and third force exerting means for movably operating cut off punch 118 and form punch 120. The third force exerting means may comprise one or more well known types of mechanical, hydraulic, pneumatic or electrically powered drive mechanisms operatively associated with the cut off and forming punch.

In operation when the slitted portion of the material reaches location D, the pressure means or member 116 moves downwardly into engagement with the material so as to securely position it relative to the cut off punch 118. Next, the cut off punch 118 simultaneously cuts the material transversely of the slitted portion positioned beneath the punch and transversely of the solid portion of the strip immediately forward of the slitted portion. While the material is held in position within the subassembly, form punch 120 moves downwardly toward form block 112 so as to form the brush fingers to the contour of the form block. For certain applications it is desirable as a part of the forming operation to coin the ends of the fingers as shown in FIG. 9.

After the cutting operation has been accomplished, the section of the strip of material which has been cut out is ejected from the apparatus through a passageway 122 provided for the purpose in the lower portion of the cutting and forming subassembly. Finally, the finished multifid brush having a configuration generally as illustrated in FIG. 8 is removed from the apparatus for packaging.

In FIGS. 11–17 there is illustrated another embodiment of the invention including a unique feeding mechanism for controllably feeding the material to be processed toward the cutting and forming subassemblies of the apparatus. As will be discussed in greater detail in the paragraphs which follow, this novel feeding mechanism completely encapsulates the material during the feeding process thereby eliminating any possibility of the material buckling or otherwise deforming as it is advanced toward the cutting and forming subassemblies. Such close confining of the material during feeding is not possible with conventional feeding systems such as conventional cooperating feeding rollers and the like. Although the drawings illustrate the feeding of a very thin elongated strip of material, the feeding mechanism of the invention is equally well suited for feeding material in other configurations such as, for example, fine wire.

Turning now to FIG. 11, the feeding mechanism of this embodiment of the invention, generally identified by the numeral 130, is shown affixed to the forward or left end of stripper block 36 by means of suitable fasteners 132. Since the various cutting and forming subassemblies of this embodiment of the invention operate in an identical manner as previously described, only the construction and operation of the feeding mechanism 130 of the invention will be considered in the paragraphs which follow.

Referring particularly to FIGS. 13 and 14, the feeding mechanism includes means 134 for encapsulating and guiding the material 18 during its advancement within the apparatus. Means 134 comprises a base plate 136 and a cover plate 138 which cooperate to define a longitudinally extending passageway or slot 140 for closely receiving the material 18. In the embodiment of the invention shown in the drawings, cover plate 138 is provided with the guide slot and the base plate is formed with a planar upper surface so that when the base plate and cover plate are interconnected in the manner shown, an elongated passageway 140 generally rectangular in cross-section will be formed. Carried by the means 134 are gripping means, generally designated by the numeral 142. In this form of the invention, the gripping means comprise first and second oppositely disposed material gripping fingers 144 and 146 respectively, each having material gripping inner extremities 145 receivable within elongated slots 147 formed in the base plate 136 and the cover plate 138 (FIG. 12). These gripping fingers are reciprocally movable relative to material 18 within bores 148 formed in first and second shuttle members 140 and 152, which members also form a part of the gripping means of the invention. As illustrated in FIGS. 14–17, shuttle members 150 and 152 are longitudinally slidable within guideways 154 defined by shoulders 155 formed in the base plate 136 and in the cover plate 138, and by guide plates 156 affixed to the base plate and cover plate by appropriate fasteners 157 (FIG. 13). Also forming a part of the gripping means of the invention are cam means generally designated as 158 (FIG. 14) for imparting reciprocal movement to said gripping fingers to move the inner extremities 145 thereof into close proximity and into gripping engagement with the material 18.

Cam means 158 comprises identically configured first and second cam members 159 and 160 respectively, each having a tapered gripping finger engaging cam face 162 forward on the upper right side thereof as viewed in FIG. 14. Each cam member is also provided with a cam driver pin 164 and a cam return pin 166 (FIG. 14), the purpose of which will presently be described. As best seen in FIG. 14, cam members 159 and 160 are longitudinally slidably carried by shuttles 150 and 152 respectively, with cam return pins 166 longitudinally movable a limited distance within slots 168 formed in shuttles 150 and 152.

Cooperatively associated with the gripping means of the invention are actuating means for operating the cam means and for moving the entire gripping means in a first or feeding direction when the fingers of the gripping means are in gripping engagement with the material and in the opposite direction when the fingers are in a released or outward position. Turning to FIGS. 11 and 12, the actuating means of this form of the invention can be seen to comprise a yoke-like activating lever 170 having spaced apart arms 171 which are pivotally interconnected near their extremities by suitable fasteners 172 to the base plate 136 and the cover plate 138. Intermediate the spaced apart arms of the yoke portion of the actuating lever are elongated slots 174 adapted to cooperatively receive cam driver pins 164 of the cam members 158 and 160.

Operation of Feeding Mechanism

Operation of the feeding mechanism of this embodiment of the invention can best be understood by referring to FIGS. 14–17. FIG. 14 shows the feeding mechanism in an at-rest starting position. Movement of actuating lever 170 to the right from the position shown in the solid lines in FIG. 12 toward the position shown in the phantom lines will, due to the urging of the yoke arms on the cam driver pins, cause cams 158 and 160 to move into the position shown in FIG. 15. During this movement the tapered cam faces 162 will cause movement of gripping fingers 144 and 146 toward each other within bores 148 formed in shuttles 150 and 152 against the urging of a biasing means. In this form of the invention, the biasing means is provided in the form of coil springs 176 surrounding fingers 144 and 146 and interposed between head portions 149 formed on the fingers and shuttles 150 and 152. This movement will continue until extremities 145 of the gripping fingers move into secure gripping engagement with the opposite surfaces of material 18.

An important feature of the invention is the provision of novel locking means adapted to resist sliding movement of shuttle members 150 and 152 until the gripping fingers are in secure engagement with the material. Referring to FIG. 13, the locking means of this embodiment of the invention can be seen to comprise first and second detent assemblies 178 and 180 carried by base plate 136 and cover plate 138 respectively. Each detent mechanism is of identical construction and comprises a threaded member 182 threadably received in the base plate and cover plate, a ball bearing 184, and a biasing means in the form of a coil spring 186 interposed between the ball bearing and the threaded member. As best seen in FIGS. 13 and 14, each of the shuttle members 150 and 152 is provided with forward and rear depressions 188*a* and 188*b* adapted to engage a portion of ball bearings 184. With this construction, coil springs 186 will continually urge ball bearings 184 toward the shuttles and at a particular point of the advance and return cycles into depressions 188 so as to releasably lock shuttles 150 and 152 against sliding movement. For example, with the mechanism in the position shown in FIG. 15, ball bearings 184 are releasably held in the forward depressions indicated by the numeral 188*a* and the detent mechanism will yieldably resist sliding movement of the shuttles. Continued pressure on actuating lever 170, however, will cause the gripping fingers to grip the material with sufficient force to overcome the resistance offered by the locking means against movement of the shuttles permitting them to be moved to the right into the position illustrated in FIG. 16. In this position, it is to be noted that the ball bearings 184 of the locking means have now moved into engagement with the rear depressions designated 188*b* in FIG. 16. It is also to be noted that this movement of shuttles 150 and 152 has resulted in concomitant movement to the right of gripping fingers 144 and 146 and in the advance of material 18 toward the cutting and forming apparatus. As illustrated in FIG. 16, the degree of longitudinal movement of shuttles 150 and 152 and the simultaneous advance of the material, is limited by shoulders 190 and 192 formed in base plate 136 and cover plate 138 respectively.

During the return cycle, movement of actuating lever 170 to the left will, in cooperation with driver pins 164, cause cams 158 and 160 to move into the position shown in FIG. 17. This movement of the cams will permit coil springs 176 to urge gripping fingers 144 and 146 outwardly or away from each other into a released position and out of engagement with the material 18. As illustrated in FIG. 17, this leftward movement of the cams has also moved cam return pins 166 into engagement with shoulders 194 formed on shuttles 150 and 152. In this position, continued movement of lever 170 to the left, however, will be resisted by the locking means, the ball bearings of which are now in depressions 188*b* in the shuttle members. Only when the exertion of forces on actuating lever 170 is sufficient to overcome the resistance offered by the locking means can longitudinal sliding movement of shuttles 150 and 152 occur. In this way, complete disengagement of the gripping fingers from the material is insured prior to returning the shuttles to the starting position illustrated in FIG. 14.

In summary, the locking means of the invention thus described insures that pivotal movement of the actuating lever will result first in forward movement of cams 159 and 160 so as to move the gripping members toward each other bringing their extremities 145 into firm engagement with the material being processed. After engagement is realized, continued forces exerted on the actuating lever will increase the forces exerted by the cams on the gripping fingers and at the same time impart forces tending to shift the cams and the shuttles forwardly. When these forces become large enough to overcome the resistance offered by the detents, the assemblies will move to the position shown in FIG. 16, thus advancing the material 18 toward the cutting and forming subassemblies. Conversely, on the return cycle the locking means releasably locks the shuttles against longitudinal movement until the cams have been moved to the left and the gripping members completely moved out of engagement with the material. It is important to note that in this regard the cam return pins 166 function only to engage shoulders 194 formed on the shuttles to effect the release of the locking means on the reverse cycle of the mechanism. As shown in FIG. 15, because of the configuration of slots 168 in the shuttles, these pins play no part in moving the shuttles forwardly or to the right. Only the pressure of the cams on the gripping fingers and the resulting pressure of the fingers on the material enables movement of the shuttles against the resistance of the locking means.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An apparatus for automatically cutting and forming multifid brush contacts from an elongated thin strip of planar material comprising:

a. first guide means for receiving the strip of material and positioning it within the apparatus;

b. means for moving the strip of material forwardly of the apparatus within said guide means;

c. first cutting means located proximate said first guide means for cutting the strip of material to a predetermined width;

d. second cutting means located forwardly of said first cutting means for forming a multiplicity of uniformly spaced apart slits in the strip of material;

e. third cutting means located forwardly of said second cutting means for cutting the strip of material transversely of the slitted portion of the strip of material so as to form a multiplicity of spaced apart finger-like projections; and f. cutting and forming means located forwardly of said third cutting means for cutting the strip of material transversely of the portion of the strip located immediately adjacent the rearward extremity of the slitted portion thereof and for forming the fingerlike projections into a predetermined cross-sectional configuration.

2. The apparatus as defined in claim 1 in which said first cutting means comprises:

a. a stop means for stopping the forward movement of the strip of material at a predetermined point within said first guide means of the apparatus;

b. die means located proximate said guide means and operatively connected therewith for receiving mating cut-off punches;

c. a pair of oppositely disposed cut-off punches movably carried by said die means and adapted to cutably engage the marginal side portions of the strip of material; and d. first force exerting means for moving said cut-off punches relative to said die means in a direction generally normal to the plane of the strip material with a force sufficient to cut off a portion of the marginal side edges of the strip of material.

3. The apparatus as defined in claim 2 in which said second cutting means comprises:

a. a first means for carrying a plurality of spaced apart first cutting blades on one side of the strip of material;

b. a second means for carrying a plurality of spaced apart cutting blades on the opposite side of the strip material in a manner such that said first and second cutting blades are disposed in substantially parallel planes but in a staggered relationship;

c. second guide means for receiving the strip of material after it has been cut by said first cutting means in a manner so as to locate the strip of material between said first and second cutting blades and to engage the margins of the strip of material so as to prevent lateral deformation of the material during the cutting operation, and d. second force exerting means for moving said first and second means toward one another in a manner so as to move the first and second cutting blades carried thereby into an interleaving relationship.

4. The apparatus as defined in claim 3 including:

a. a plurality of first spacer blades disposed in an interleaving relationship with said first cutting blades;

b. a plurality of second spacer blades disposed in an interleaving relationship with said second cutting blades;

c. means interconnected with said first spacer blades for moving said first spacer blades in a direction away from said second cutting blades as said first and second means move toward one another; and d. means interconnected with said second spacer blades for moving said second spacer blades in a direction away from said first cutting blades as said first and second means move toward one another.

5. An apparatus for cutting and forming a thin planar material comprising:

a. a first means for carrying a plurality of spaced apart first cutting blades;

b. a second means oppositely disposed from said first means for carrying a plurality of spaced apart second cutting blades in planes substantially parallel to but in a staggered relationship with the planes of said first cutting blades, said first and second means being reciprocatively movable relative to each other;

c. guide means for fixedly locating the material to be cut longitudinally of the apparatus in between the cutting blades carried by said first and second means in a manner so as to prevent lateral deformation of the material during the cutting operation;

d. force exerting means for reciprocatively moving said first and second means in a direction toward one another in a manner so as to move the first and second cutting blades carried thereby into an interleaving relationship whereby said cutting blades penetrate the material to be cut from opposite sides thereof forming a plurality of spaced apart generally parallel slits therein, there being no lateral deformation of the material;

e. a plurality of first spacer elements disposed in an interleaving relationship with said first cutting blades;

f. a plurality of second spacer elements disposed in an interleaving relationship with said second cutting blades;

g. means interconnected with said first spacer elements for moving said first spacer elements in a direction away from said second cutting blades as said first and second means move toward one another; and h. means interconnected with said second spacer elements for moving said second spacer elements in a direction away from said first cutting blades as said first and second means move toward one another.

6. The apparatus as defined in claim 5 in which said first and second cutting blades are arranged so as to cut the strip material longitudinally and in which the cutting faces of said cutting blades are roughened to prevent the material from slipping or tearing during the cutting operation.

7. The apparatus as defined in claim 6 including means for cutting the strip material laterally at a location proximate one end of the longitudinal cuts made in the strip material by said first and second cutting blades so as to form a plurality of spaced apart finger-like elements.

8. The apparatus as defined in claim 7 including means for forming the end portions of the finger-like elements into a predetermined cross-sectional configuration.

9. An apparatus for cutting and forming a thin planar material having generally parallel edges, comprising:

a. guide means for holding the planar material to be cut in a fixed position longitudinally of the apparatus and supporting it along its edges to prevent lateral deformation of the material;

b. a first movable means disposed on the first side of the material and movable toward and away therefrom;

c. a plurality of spaced apart first cutting blades carried by and movable with said first movable means;

d. a second movable means disposed on the opposite or second side of the material and movable toward and away therefrom;

e. a plurality of spaced apart second cutting blades carried by and movable with said second movable means in a manner such that said first and second cutting blades are disposed in substantially parallel planes but in a staggered relationship;

f. means for moving said first and second movable means into mating juxtaposition so that said first and second cutting blades carried thereby are moved into an interleaving relationship whereby a plurality of spaced apart generally parallel slits are formed in the material;

g. a third movable means disposed on the first side of the material and movable relative to said first movable means;

h. a plurality of spaced apart first spacer blades carried by and movable with said third movable means, said blades being disposed in an interleaving relationship with said first cutting blades;

i. a fourth movable means disposed on the second side of the strip of material and movable relative to said second movable means; and j. a plurality of spaced apart second spacer blades carried by and movable with said fourth movable means, said blades being disposed in an interleaving relationship with said second cutting blades.

10. An apparatus for cutting and forming a thin planar material having generally parallel edges, comprising:

a. guide means for holding the planar material to be cut in a fixed position and supporting it along its edges to prevent lateral deformation of the material;

b. a first movable means disposed on the first side of the material and movable toward and away therefrom;

c. a plurality of spaced apart first generally planar cutting blades carried by and movable with said first movable means;

d. a second movable means disposed on the opposite or second side of the material and movable toward and away therefrom;

e. a plurality of spaced apart second generally planar cutting blades carried by and movable with said second movable means in a manner such that said first and second cutting blades are disposed in substantially parallel planes but in a staggered relationship;

f. a third movable means disposed on the first side of the material and movable relative to said first movable means;

g. a plurality of spaced apart first spacer blades carried by and movable with said third movable means, said blades being disposed in an interleaving relationship with said first cutting blades;

h. a fourth movable means disposed on the second side of the strip of material and movable relative to said second movable means;

i. a plurality of spaced apart second spacer blades carried by and movable with said fourth movable means, said blades being disposed in an interleaving relationship with said second cutting blades;

j. means for moving said first and second movable means toward each other in a manner so as to move said first and second cutting blades into an interleaving relationship;

k. first reaction means operably associated with said third movable means for, in response to movement of said second movable means, moving said third means in a direction away from the material a distance corresponding to the distance moved by said second movable means in a direction toward the material; and l. second relative means operably associated with said fourth movable means for, in response to movement of said first movable means, moving said fourth means in a direction away from the material a distance corresponding to the distance moved by said first movable means in a direction toward the material.

11. A method of forming multifid brush contacts from a thin strip of planar material comprising the steps of:

a. cutting the strip of material to a predetermined width;

b. at a first cutting station engaging the margins of the material so as to fixedly locate the material within the cutting station and prevent lateral deformation thereof;

c. forming a multiplicity of spaced apart generally parallel slits in the material while supporting the material against lateral deformation; and d. at a second cutting station cutting the material laterally at a location proximate one end of the slits formed therein so as to form a multiplicity of spaced apart fingers.

12. A method as defined in claim 11 in which at said second cutting station the material is compressed so as to urge the spaced apart fingers into a coplanar configuration.

13. A method as defined in claim 12 including the step of coining the free ends of the spaced apart fingers.

14. The apparatus as defined in claim 1 in which said means for moving the strip of material forwardly of the apparatus comprises a feed mechanism including:

a. means for encapsulating and guiding the strip of material during forward movement thereof;

b. gripping means carried by the aforesaid means for alternately gripping and releasing the material and;

c. actuating means for moving said gripping means in a first direction when said gripping means are gripping the material and in the opposite direction when said gripping means are in a released position.

15. The apparatus as defined in claim 14 in which said means for encapsulating and guiding the strip of material comprises a cooperating base plate and cover plate together defining a longitudinally extending passageway for closely receiving the strip of material.

16. The apparatus as defined in claim 15 in which said gripping means comprise:

a. first and second oppositely disposed material gripping elements reciprocatively movable relative to said passageway; and b. cam means for imparting reciprocal movement to said gripping elements to move the extremities thereof into close proximity.

* * * * *